United States Patent [19]

Herber et al.

[11] Patent Number: 4,471,536

[45] Date of Patent: Sep. 18, 1984

[54] DEVICE FOR DRYING COAL

[75] Inventors: Peter Herber, Zwettl; Pavle Ivanovski, Linz; Ernst Oberndorfer, Ried; Wilfried Zieri, Linz, all of Austria

[73] Assignee: Voest-Alpine Aktiengesellschaft, Vienna, Austria

[21] Appl. No.: 379,611

[22] Filed: May 18, 1982

[30] Foreign Application Priority Data

Jun. 19, 1981 [AT] Austria ..... 2731/81

[51] Int. Cl.[3] ..... F26B 19/00

[52] U.S. Cl. ..... 34/60; 34/9; 34/29; 34/167

[58] Field of Search ..... 34/9, 15, 29, 60, 61, 34/167, 180, 181; 44/12, 10 E, 10 J

[56] References Cited

U.S. PATENT DOCUMENTS 3,197,415 7/1965 Hendrix ..... 34/60 X 3,937,521 2/1976 Reuter ..... 34/60

*Primary Examiner*—John J. Camby

*Attorney, Agent, or Firm*—Cushman, Darby & Cushman

[57] ABSTRACT

The device for drying coal comprises a plurality of damping vessels wherein the coal is pre-heated by means of steam and/or hot water, thereupon damped in a second stage, and finally pressure-released. The several damping vessels 1–17 are combined to form groups. Each of these groups is provided with a common group conduit 18 conveying live steam for damping, with a common group conduit 19 conveying wet steam from vessels for overflowing other vessels, and with a common group conduit 20 conveying hot water for rinsing. Over the damping vessels 1–17, there are provided distribution conduits which extend over all groups and which are conveying live steam 38, wet steam for overflowing 39, and hot water for rinsing 40. The group conduits 18,19,20 are connectable via valves 41,42,43 to the distribution conduits 38,39,40. Thus it is possible to include selectively into the procedure of any group any vessel of another group or the additional vessel 17 (FIG. 1).

3 Claims, 4 Drawing Figures

3-FOLD DAMPING CYCLE

Figure 1:
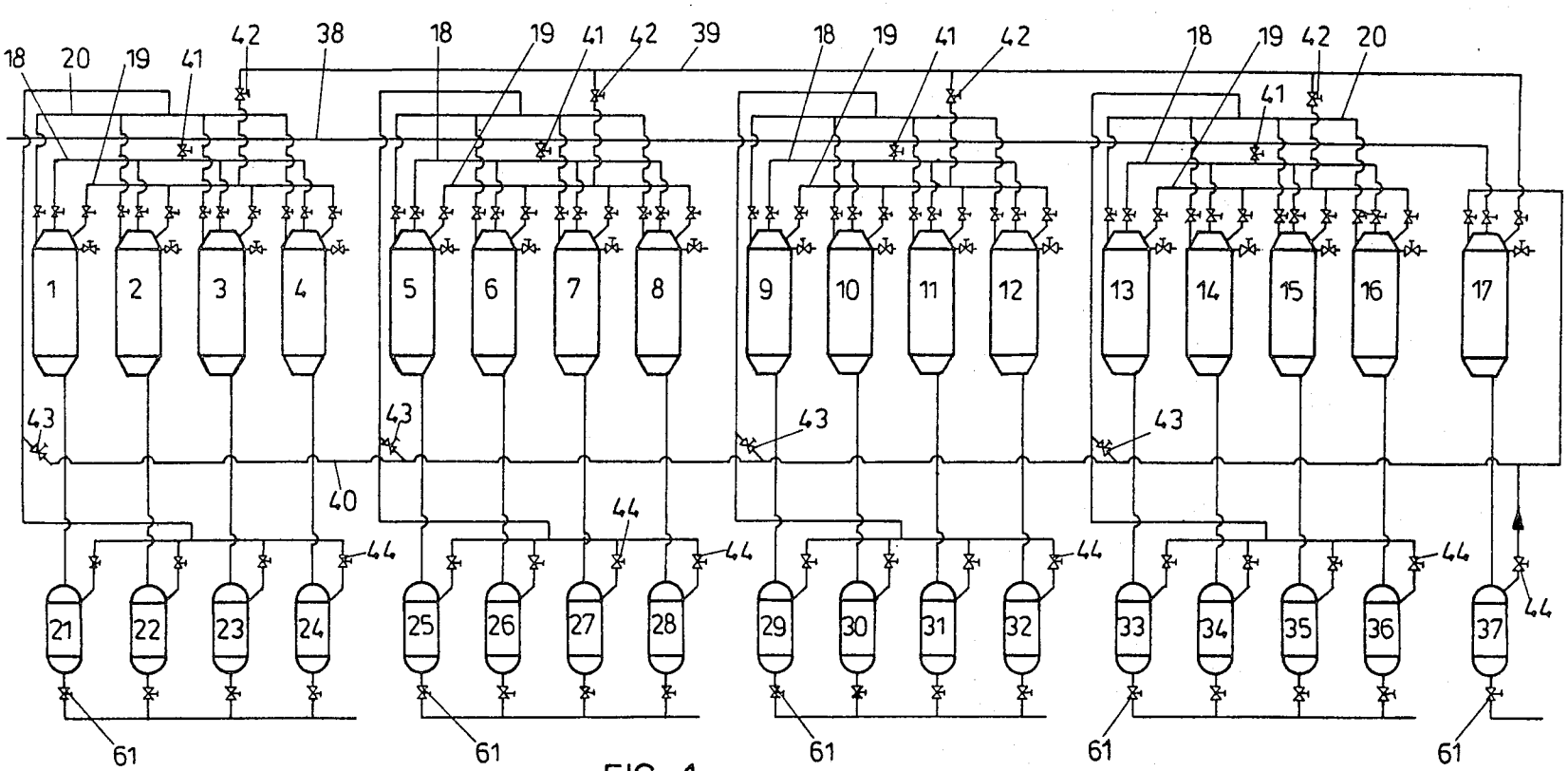

| | T | | | | | |
|---|---|---|---|---|---|---|
| 1 | EF | 1V | 2V | D | 1E | 2E |
| 2 | 1E | 2E | EF | 1V | 2V | D |
| 3 | 2V | D | 1E | 2E | EF | 1V |

4-FOLD DAMPING CYCLE

| | T | | | | | | | |
|---|---|---|---|---|---|---|---|---|
| 1 | EF | 1V | 2V | D | D | D | 1E | 2E |
| 2 | 1E | 2E | EF | 1V | 2V | D | D | D |
| 3 | D | D | 1E | 2E | EF | 1V | 2V | D |
| 4 | 2V | D | D | D | 1E | 2E | EF | 1V |

5-FOLD DAMPING CYCLE

| | T | | | | | | | | | |
|---|---|---|---|---|---|---|---|---|---|---|
| 1 | EF | 1V | 2V | D | D | D | D | D | 1E | 2E |
| 2 | 1E | 2E | EF | 1V | 2V | D | D | D | D | D |
| 3 | D | D | 1E | 2E | EF | 1V | 2V | D | D | D |
| 4 | D | D | D | D | 1E | 2E | EF | 1V | 2V | D |
| 5 | 2V | D | D | D | D | D | 1E | 2E | EF | 1V |

EF -DISCHARGING AND FILLING
1V -IST HEATING STEP
2V -2ND HEATING STEP
D -DAMPING
1E -IST PRESSURE RELEASE
2E -2ND PRESSURE RELEASE
T -

FIG. 4

DEVICE FOR DRYING COAL

This invention relates to a device for drying coal, particularly lignite, using steam and/or hot water, the coal being preheated by means of steam and/or hot water, thereupon damped and finally pressure-released, the said device comprising several damping vessels (reaction vessels) which are connectable with each other to form a group, and which are connectable through valves with distributing conduits carrying live steam, wet steam overflowing from other vessels, and hot water coming from supplementary vessels. Devices of the described kind have become known, e.g., from the Austrian Patent Specification No. 287 648. Combining a plurality of damping vessels to a common group gives a better coefficient of utilization of the brought-in energy. Depending on the number of damping vessels combined to form a group, cyclical programs may be established according to which firstly the several vessels must be filled with the material to be dried. Thereupon, the first step consists in pre-heating the material. For this purpose, hot water condensed or expelled out of a damping vessel wherefrom it was collected in a supplementary vessel, can be rinsed over the coal to be pre-heated after opening the respective valve. Thereupon, the pre-heating water can be conveyed again into the concerned supplementary vessel. Usually, a second pre-heating process is carried out by the help of steam. This pre-heating steam is taken from another vessel of the same group where the damping phase has just ended. In overflowing of steam from that other vessel into the vessel where the second pre-heating step shall be carried out, a partial decrease of pressure occurs until the pressure in these two vessels is nearly equalized. With known devices of the kind, this first release of saturated steam pressure begins at about 30 bar so that the pressure within both vessels equalizes at about 8 bar. After the second pre-heating step, live steam is introduced into the vessel whereby the drying process is accomplished according to the Fleissner method. When the said damping phase has been terminated, the first pressure release is accomplished in the first damping vessel, from which wet steam is conveyed into another damping vessel within the same group where the second pre-heating phase is in course. Since the first pressure-releasing stage does not yet reach the normal atmospheric pressure, the subsequent second pressure release can be utilized for the first pre-heating process in another vessel by rinsing with hot water, this hot water being conveyed from the supplementary vessel of the first damping vessel into a damping vessel where the first pre-heating is to be carried out. The pressure which remains in the first damping vessel after the second pressure-remaining step is fully released by opening an outlet to the outer atmosphere. Thereupon, the lower flap of the damping vessel may be opened to discharge the same whilst after closing the lower flap and opening the upper flap the vessel can be filled with new coal to be dried. Depending on the lay-out of the instalment, certain different cycles can be carried out in accordance with predetermined programs. The efficiency of such an installment may be greatly deteriorated if a single vessel is impeded in production. If one vessel within a group falls out, it may be necessary to shut down all vessels of this group until the damage is repaired. If common conduits are foreseen for connection between the different vessels, it would be within the range of possibility, provided an appropriate valve control, to proceed upon a three-vessel cycle as shown in the Austrian Patent Specification No. 287 648 instead of a four-vessel cycle. But this would mean a severely diminished performance. By no means it is allowed, with the known devices, to adapt the procedure to an actual need in order to answer in an economical degree to varying necessities in dependency of the material to be dried.

The scope of the present invention consists in an improvement of the above described device in pursuance of which it shall be no longer necessary to continue working with restricted programs or even without one complete group if one or more damping vessels should be out of function. On the contrary, in such a case it shall be possible to maintain fully the activeness of the instalment. In order to solve this problem, the invention is mainly characterized in that the distributing conduits of each group are connectable beyond their group with the distributing conduit of at least one other group or, at least, with one additional damping vessel. In this way it is possible to effect rinsing in any damping vessel with hot water taken from any supplementary vessel even appertaining to another group, and also it is possible to let overflow wet steam between whatever vessel of one group and vessels appertaining to whatever other part of the instalment. Such an arrangement allows to adapt the total number of damping vessels which shall cooperate in one group, and, consequently, it is possible to procede readily in 5-fold or 6-fold cycles if it seems advantageous and economical with relation to the production and to the material to be dried. Such a high degree of flexibility in processing is secured in an easily dirigible manner, when according to the invention at least the group conduits conveying hot water from the supplementary vessels and the group conduits conveying steam from the damping vessels are connectable via shut-off valves to at least one separate junction conduit extending over the whole of the groups.

To enable this, the immersion tubes serving as conduits from the supplementary vessels are controllable by valves. They are ending into a group conduit or an ascending tube wherefrom connections convey to the several damping vessels for rinsing the same. These connections, of course, are again controllable by valves. This example is valid for make connections within one group. For connecting to vessels of another group or to a reserve vessel, there is provided a branch conduit which leads through valves from the aforesaid ascending conduit to a group conduit of a neighbouring group or to a reserve vessel. In this way, additional junctions are possible.

Also the overflow conduits of the vessels of one group can be closed by valves. They are combined to a damping group conduit to enable overflowing with wet steam between all vessels of one group. A junction conduit combining the several group conduits (ascending conduits) allows joining the vessels of neighbouring groups or the reserve vessel. This construction allows, in case of defect of one vessel, to continue working upon a 3-fold cycle, or to connect these vessels additionally to other groups, or to join up any reserve vessel. Should the said reserve vessel not be needed as a replacement, it would be possible, e.g., to join up the same to any other group as a fifth damping vessel (reaction vessels). Furthermore, this separate connecting conduit gives occasion during the overflow phase for compensating the pressure beyond the separate group, the device being laid out preferably in such a manner that valves of different groups controlling the entrance of overflowing wet steam from damping vessels into the common distributing conduit can be coupled together for parallel opening and closing movement. So it is possible to combine at the same time two or more damping vessels of different groups during the first pressure releasing period with two or more vessels in which the second pre-heating is to be carried out. This results in a particularly economical and constant desiccation performance.

In the following, the invention shall be further illustrated with reference to the examples shown in the drawing.

Figure 2:
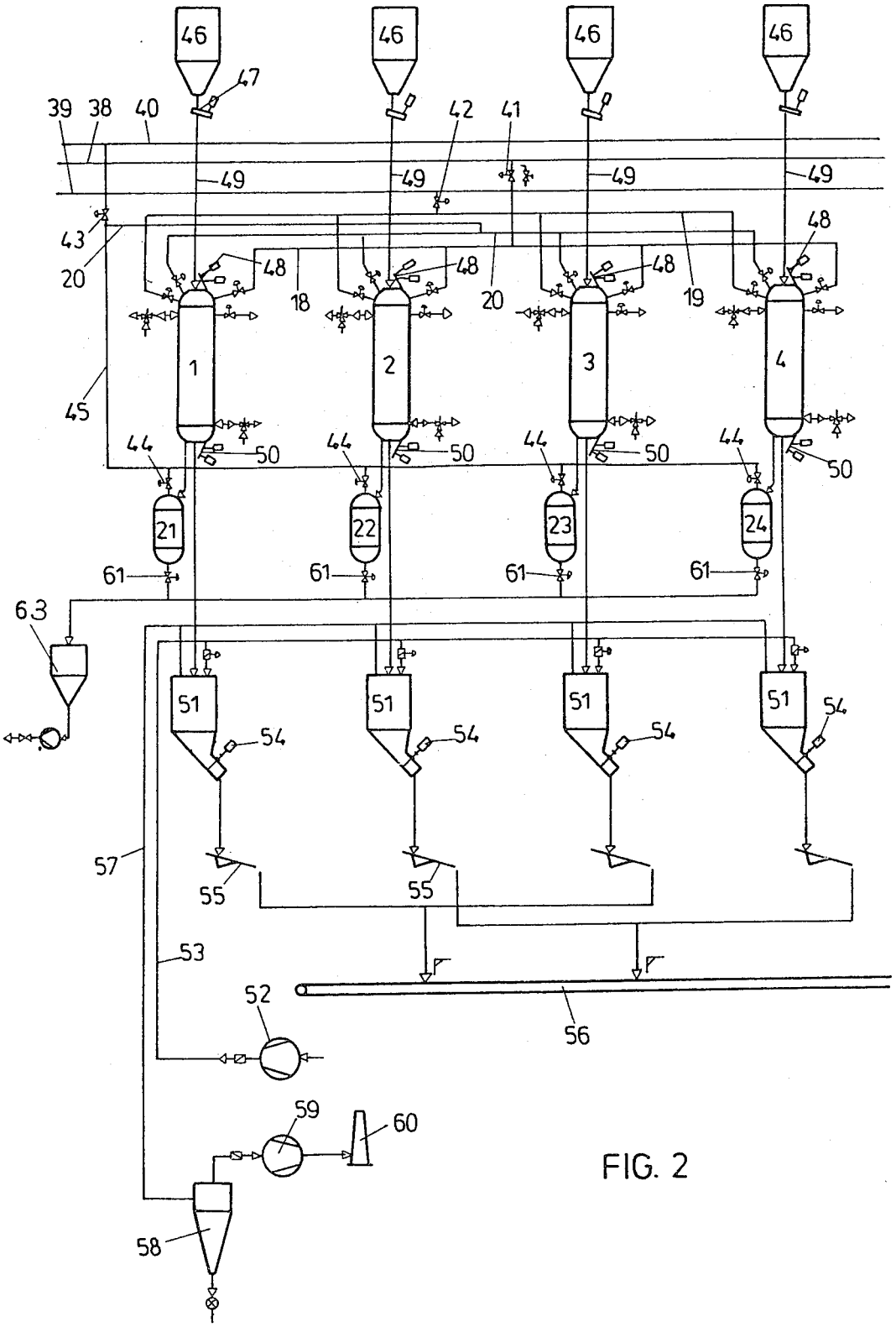
Figure 3:
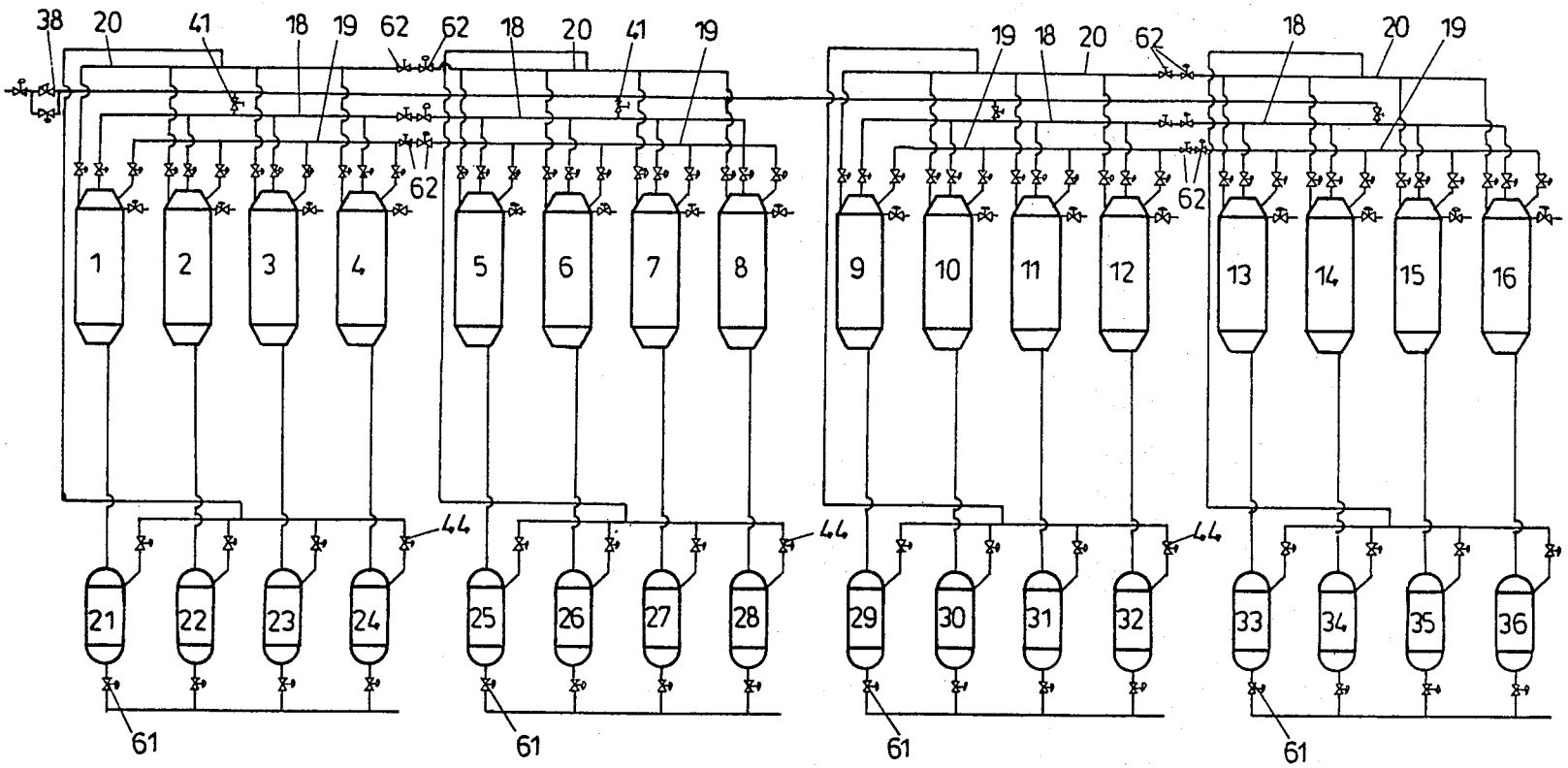

In the drawing,

FIG. 1 shows a graphical representation of the disposition of the conduits,

FIG. 2 in an enlarged scale a complete group taken out from the total arrangement of FIG. 1, FIG. 3 another execution of the apparatus according to the invention, and FIG. 4 the operating sequence of the process when using 3, 4 or 5 steaming vessels forming a common cycle with constant cycle period.

FIG. 1 shows only the steaming vessels no. 1 to no. 17. The steaming vessels are combined to four groups comprising the the vessels 1–4, 5–8, 9–12, and 13–16, respectively. The conduits 18 are live steam conduits for each of the vessel groups. The conduits 19 serve for supplying saturated steam coming from other vessels, whilst for rinsing with hot water there are provided the conduits 20. Reference numeral 17 designates a reserve vessel. To each of the steaming vessels 1–17, there is adjoined a supplementary vessel 21–37.

Furthermore, there are provided junction conduits travesting all groups, reference numeral 38 carrying live steam, 39 saturated steam, 40 hot water for rinsing. The several group conduits 18, 19,20 are connectable to the respective junction conduits 38, 39,40 through the valves 41,42, and 43, respectively. Besides that, each of the steaming vessels is provided with the corresponding number of valves connecting the same with the group conduits.

Should e.g. the vessel 12 within this arrangement become defective, it is possible to annex the reserve vessel 17. In this case, by opening the valve 44 of the supplementary vessel 37 hot water for rinsing in the first pre-heating phase can be supplied, e.g., into the vessel 11 through the junction conduit 40 and the group conduit 20. Analogically, the reserve vessel may be connected with the vessel 7 for delivering saturated steam. In this case, the valve 42 situated between the group conduit 19 and the junction conduit 39 is to be opened.

FIG. 2 shows the first group of vessels in a larger scale. The steaming vessels are designated by 1,2,3 and 4, and their supplementary vessels by 21,22,23 and 24. The valves of the latter have the same numerals 44 as in FIG. 1. Ascending conduits 45, leading into the group conduit 20 are connectable with the supplementary vessels by the said valves 44. On the other hand, the group conduit 20 can be connected through a valve 43 with the junction conduit 40 extending over all vessel groups. Again the junction conduit which serves for overflowing the vessels with steam is designated 39, and the junction conduit common to all groups which serves for delivering live steam has the reference numeral 38. Above each of the steaming vessels 1 to 4, there is provided a charging bunker 46 with a hydraulic flap 47 to close the same. When the upper flap 48 of a steaming vessel is opened, the latter may be filled through the filling tube 49. Besides that, each of the vessels is provided with a lower flap 50 for discharging the desiccated coal which then is conveyed into a vessel where it undergoes an after-aeration. Into this vessel 51, there may be introduced compressed air through a conduit 53 by means of a blower 52 whereby the desiccated coal is cooled and undergoes a secondary drying process. Through a variable outlet flap 54 the dried coal reaches a vibrator 55 and thereupon a discharge conveyor 56. The dust-laden air coming from the aeration vessels 51 is removed through suction conduits 57 and purified in a cyclone 58. The outgoing air is blown off through a chimney 60 by means of another blowing engine 59.

The hot water which has already become cooler to a great extent, and especially that water which after a pre-heating process was conducted from a steaming vessel into a corresponding supplementary vessel, all this water, after being brought out through valves 61, reaches a sludge water basin 63 for further treatment.

The damping vessels 1–4 are provided with a multiplicity of valves through which each of them is connectable to the group conduits 18,19,20. In this way, all damping vessels of one group may be selectively connected with each other. Additionally it is possible, like the arrangement according to FIG. 1, to get a connection through the valves 41,42,43 to the junction conduits which are common to all groups. Thus it is possible to connect additionally a reserve vessel or any vessels of another group.

FIG. 3 shows a totality of 16 steaming vessels 1–16, which are subdivided in four groups, each of them comprising 4 vessels. The conduits are laid out in such a manner that two groups at a time are connectable to each other. The damping vessels are designated by the numerals 1 to 16, the supplementary vessels have the reference numbers 21 to 36. A difference against FIGS. 1 and 2 consists in that only the live steam conduit 38 is arranged over the whole of the groups, each group conduit 18 for live steam being connectable to conduit 38 by a valve 41. The group conduits 19 carrying wet steam coming from the damping vessels, and the group conduits 20 carrying hot water for pre-heating, are connectable via valves 62 to the corresponding group conduits of a neighboring group. Thus it is possible to utilize the vessels of an adjacent group to complete a damping cycle.

FIG. 4 shows chronologically the procedure in a 3, 4 or 5-fold damping cycle. EF means discharging and filling the damping vessels, 1V and 2V the 1st and 2nd pre-heating step, the 1st pre-heating being carried out with hot water, the 2nd one with wet steam coming from other vessels of the same cycle. D designates the damping process. 1E is the 1st pressure releasing step consisting in withdrawal of wet steam for pre-heating another vessel, whilst the 2nd pressure releasing step, 2E, serves for accomodation to the atmospheric pressure, since the 1st releasing step occurs within a superatmospheric range of pressure.

What is claimed is:

1. In apparatus for drying lignite:

a plurality of group of reaction vessels, each group including a plurality of vessels;

a junction live steam conduit;

a plurality of group live steam conduits each of which is connected to each vessel of a respective group of vessels via a separate valve associated with each vessel of the respective group, each group live steam conduit being connected to the junction live steam conduit via a valve associated with each respective group conduit;

a junction saturated steam conduit;

a plurality of group saturated steam conduits each of which is connected to each vessel of a respective group of vessels via a separate valve associated with each respective vessel, each group saturated steam conduit being connected to the junction saturated steam conduit by a valve associated with each respective group conduit;

a junction hot water conduit;

a plurality of group hot water conduits each of which is connected to each vessel of a respective group of vessels via a separate valve associated with each respective vessel, each group hot water conduit being connected to the junction hot water conduit by a valve associated with each respective group conduit.

2. Apparatus as in claim 1 including a supplementary hot water vessel associated with each reaction vessel; a supplementary hot water conduit common to each group of reaction vessels and connected to each vessel of the respective group via a separate valve associated with each reaction vessel of the respective group, each supplementary hot water conduit also being connected to the group hot water conduit which is associated with the vessels of that group.

3. Apparatus as in claim 1 wherein the valves connecting the junction saturated steam conduit with the group saturated steam conduits are provided with means for parallel opening and closing of said valves.

* * * * *